US009682017B2

(12) United States Patent
Ronen-Lulu

(10) Patent No.: US 9,682,017 B2
(45) Date of Patent: Jun. 20, 2017

(54) BABY BOTTLE

(71) Applicant: Omri Ronen-Lulu, Philadelphia, PA (US)

(72) Inventor: Omri Ronen-Lulu, Philadelphia, PA (US)

( * ) Notice: Subject to any disclaimer, the term of this patent is extended or adjusted under 35 U.S.C. 154(b) by 0 days.

(21) Appl. No.: 14/795,038

(22) Filed: Jul. 9, 2015

(65) Prior Publication Data

US 2017/0007503 A1 Jan. 12, 2017

(51) Int. Cl.
*A61J 9/00* (2006.01)
*A61J 11/04* (2006.01)

(52) U.S. Cl.
CPC ..... *A61J 9/00* (2013.01); *A61J 11/04* (2013.01); *A61J 2200/76* (2013.01)

(58) Field of Classification Search
CPC ..... A61J 9/00; A61J 9/0607
USPC ..... 215/11, 1; D24/127, 128, 197, 198
See application file for complete search history.

(56) References Cited

U.S. PATENT DOCUMENTS

| | | | | | |
|---|---|---|---|---|---|
| 2,514,744 | A | | 7/1950 | Cipyak | |
| 2,926,805 | A | * | 3/1960 | Mead | A61J 9/00 215/11.1 |
| 3,028,983 | A | | 4/1962 | Barr | |
| 4,930,645 | A | * | 6/1990 | Warehime | A63H 33/00 215/11.1 |
| 5,069,351 | A | * | 12/1991 | Gunderson | A61J 11/008 215/11.1 |
| 5,263,599 | A | | 11/1993 | Sklar | |
| D368,311 | S | * | 3/1996 | Cockram | D24/197 |
| D426,893 | S | * | 6/2000 | Pfiffner | D24/198 |
| D510,525 | S | * | 10/2005 | Honkawa | D9/519 |
| D547,196 | S | * | 7/2007 | Lepoitevin | D21/632 |
| 7,347,337 | B2 | | 3/2008 | Schultheis et al. | |
| 2009/0088684 | A1 | | 4/2009 | Rohrig | |
| 2009/0178479 | A1 | | 7/2009 | Pagovich et al. | |

* cited by examiner

*Primary Examiner* — Sue A Weaver
(74) *Attorney, Agent, or Firm* — Norman E. Lehrer

(57) ABSTRACT

A baby bottle includes a clear housing with a clear container within the housing. The container is comprised of five hollow spheres arranged axially one above the other and in fluid communication with each other. Each sphere holds approximately one ounce of liquid. An inverted funnel is in communication with the lowermost sphere and also holds about one ounce of liquid. A cap carrying a nipple is adapted to connect to the top of the uppermost sphere so that the nipple is in fluid communication with the interior of the plurality of spheres.

5 Claims, 5 Drawing Sheets

BABY BOTTLE

BACKGROUND OF THE INVENTION

The present invention is directed toward a baby bottle or infant feeding bottle and more particularly, toward such a bottle that more easily and accurately informs the parent or other caretaker of the amount of liquid that has been consumed by the child.

When bottle feeding an infant or young child, it is important to ensure that the bottle's nipple remains full of milk, formula or other liquid in order to prevent the ingestion of air during the nursing process. Accordingly, during feeding, the bottle is normally held in an inverted position. The angle at which the bottle is held will, of course, vary during the feeding process in order to ensure that there is no air in the nipple. As the bottle feeding progresses, the amount of air in the bottle relative to the amount of liquid increases. The angle of the bottle must, therefore, be increased until, eventually, the bottle is substantially upside down.

During feeding, it is also desirable to monitor the amount of liquid remaining in the bottle in order for the parent or other caregiver to determine how much liquid has been ingested by the infant. Traditional nursing bottles frequently have graduated markings on the side of the bottle to indicate the amount of liquid contained therein. Conventional markings extend parallel to the bottom of the bottle and are sequentially numbered. To read the numbers, however, the bottle must be turned upright and the amount of fluid remaining in the bottle read by simply comparing the fluid level to the graduated markings.

Conventionally marked bottles require that the feeding be interrupted from time to time so that the bottle can be returned to its upright position in order to determine the amount of fluid remaining. Such interruptions of the feeding are undesirable since it may be difficult or impossible to make the infant resume feeding. See, for example, FIG. 2 of U.S. Pat. No. 2,514,744 to Cipyak and U.S. Pat. No. 7,347,337 to Schultheis et al.

To address this problem, it has been proposed to provide baby bottles with markings located in parallel slanted planes extending through the bottle. Examples of these arrangements can be found in U.S. Pat. No. 5,263,599 to Sklar and U.S. Pat. No. 3,028,983 to Barr. The purpose of the slanted oval markings is allegedly to allow the caregiver to read the lines while the bottle is being held in its slanted position. Unfortunately, these arrangements have not proven to be satisfactory.

Slanted parallel markings are generally not helpful since they assume a generally constant bottle orientation during feeding. In practice, however, the angle of the bottle tends to vary during feeding until the bottle reaches a substantially vertical orientation. Thus, providing a plurality of parallel markings on the bottle cannot provide an accurate indication of the amount of fluid remaining in the bottle.

A need exists, therefore, for a baby or nursing bottle that allows a caregiver to accurately monitor the amount of liquid being consumed while the infant is being fed and without having to remove the nipple from the baby's mouth.

SUMMARY OF THE INVENTION

The present invention is designed to overcome the deficiencies of the prior art discussed above. It is an object of the present invention to provide a baby bottle that does not require the use of lines or other markings on the outside thereof for measuring the quantity of liquid being consumed.

It is another object of the present invention to provide a baby bottle that provides an accurate indication of the quantity of liquid being consumed while the baby or infant is being fed.

It is a still further object of the present invention to provide a baby bottle that does not require the use of lines or other markings on the outside thereof but which provides an accurate indication of the quantity of liquid being consumed while the baby or infant is being fed.

In accordance with the illustrative embodiments demonstrating features and advantages of the present invention, there is provided a baby bottle which includes a clear housing with a clear container within the housing. The container is comprised of five hollow spheres arranged axially one above the other and in fluid communication with each other. Each sphere holds approximately one ounce of liquid. An inverted funnel is in communication with the lowermost sphere and also holds about one ounce of liquid. A cap carrying a nipple is adapted to connect to the top of the uppermost sphere so that the nipple is in fluid communication with the interior of the plurality of spheres.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
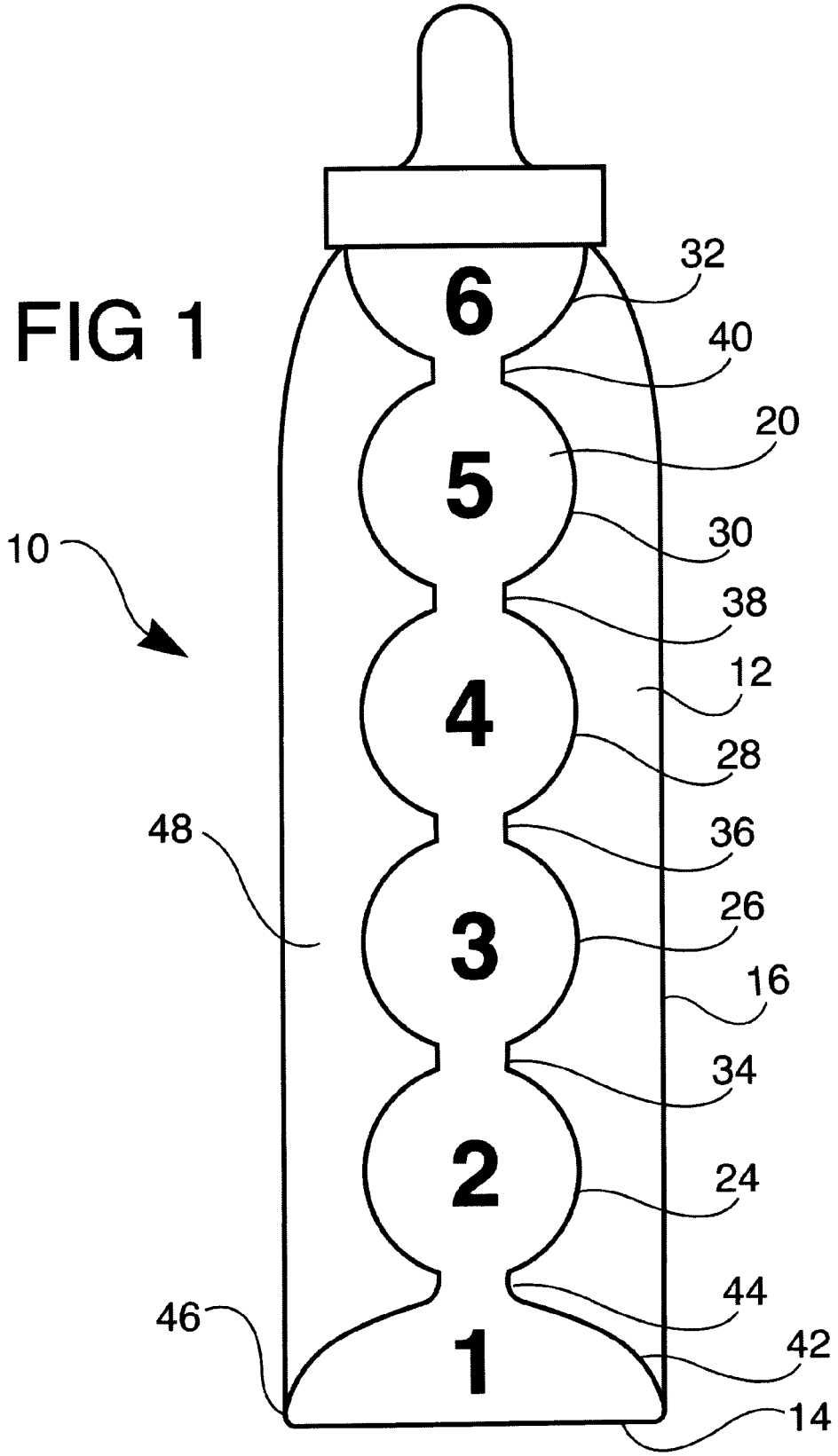
FIG. 1 is a front perspective view of an empty baby bottle of my invention.

Referring now to the drawings in detail wherein like reference numerals have been used throughout the various figures to designate like elements, there is shown in FIGS. 1-5 a baby bottle constructed in accordance with the principles of the present invention and designated generally as 10.

The baby bottle 10 is comprised of several component parts including a substantially cylindrically shaped housing 12 that essentially resembles a conventional baby bottle. The housing 12 includes a bottom 14, a cylindrical side wall 16 and a threaded open top 18 (shown in FIG. 3). The housing 12 may be made of glass or plastic or other suitable material. It is preferably transparent or at least translucent from the side so that the interior thereof can be seen from outside of the housing.

The interior space 20 within the housing 12 is adapted to hold a quantity of milk, juice, formula or other liquid 22. The space 20 is formed by a plurality of hollow spheres 24, 26, 28, 30 and 32. The term "sphere" as used herein is intended to refer to a shape that is exactly spherical and to shapes that resemble spheres such as a hollow shape that may be slightly flattened or somewhat oval. In any event, the spheres are arranged vertically one above the other and preferably in axial alignment and having substantially the same diameter from left to right as viewed in FIGS. 1-3. The interiors of the spheres are spaced apart from each other as shown but are in fluid communication with each other through the plurality of small tubes 34, 36, 38 and 40. As shown in the figures, the diameters of the tubes are no greater than one-third the diameter of the spheres. While five spheres are shown, it should be readily apparent to those skilled in the art that more or fewer spheres could be utilized without departing from the spirit of the invention.

The lowermost sphere 24 is in fluid communication with an inverted funnel-like member 42 through a small tube 44. The bottom or extreme edge 46 of the funnel 42 is sealed to the inside bottom 14 of the housing 12 so that liquid 22 in the funnel 42 does not enter the space 48 within the housing 12 that surrounds the interior liquid containing space 20.

The top upper open end 18 of the container 12 is similarly sealed to the top of the uppermost sphere 32 and includes an exterior thread 48 thereon. A conventional cap 50 and nipple 52 can be threaded onto the sphere 32 in a manner well known in the art.

As with the housing 12, the spheres and the funnel may be made of glass or plastic or other suitable material. They are also preferably transparent or at least translucent so that liquid within them can be seen through them and from outside of the housing. Furthermore, each sphere and the funnel preferably are capable of containing one ounce of liquid and each preferably has a number 1 to 6 clearly printed thereon as shown in the figures. These numbers are also visible from the exterior of the housing 12.

Figure 2:
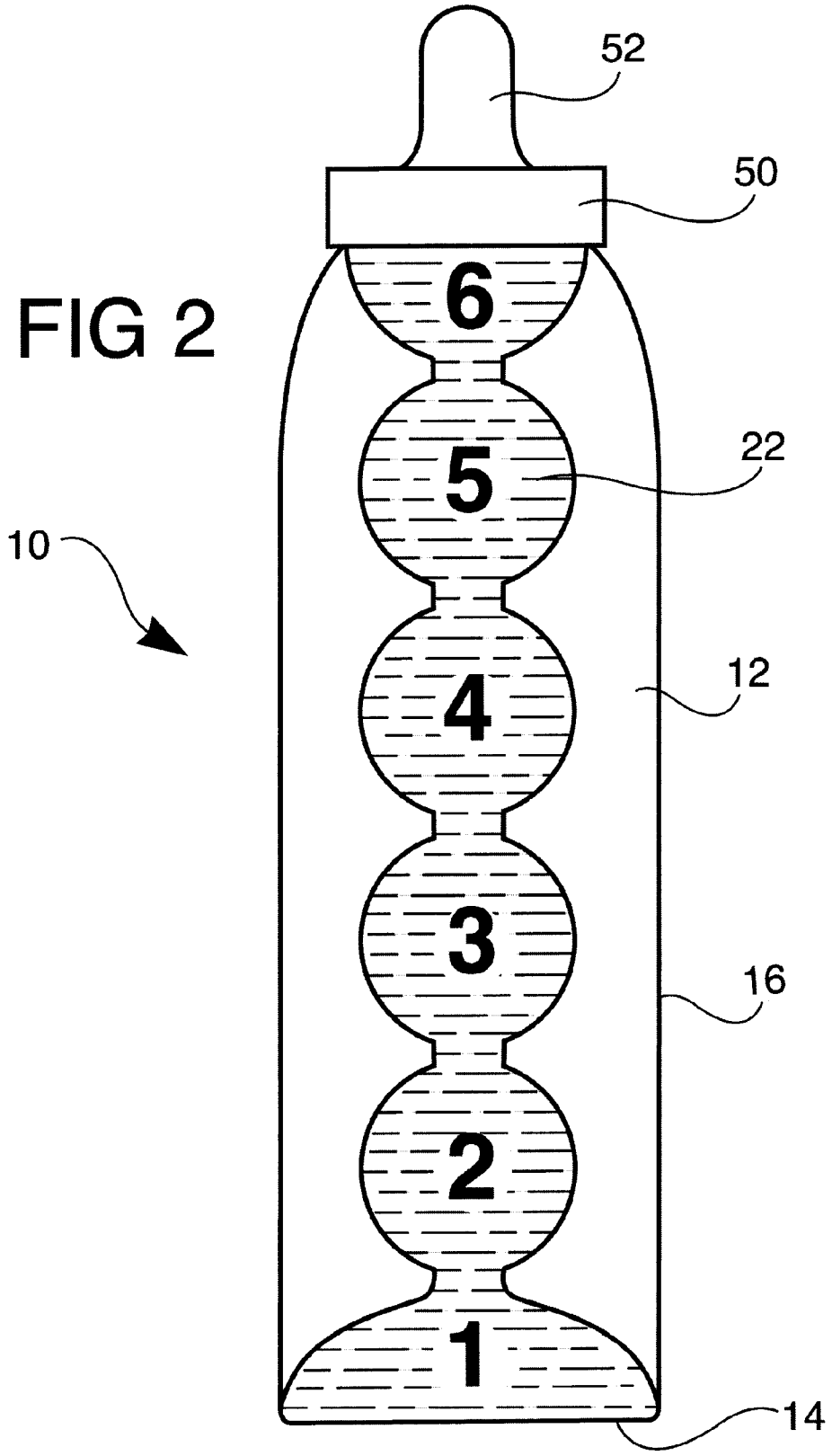
FIG. 2 is a front perspective view similar to FIG. 1 but shown filled with a liquid.
Figure 3:
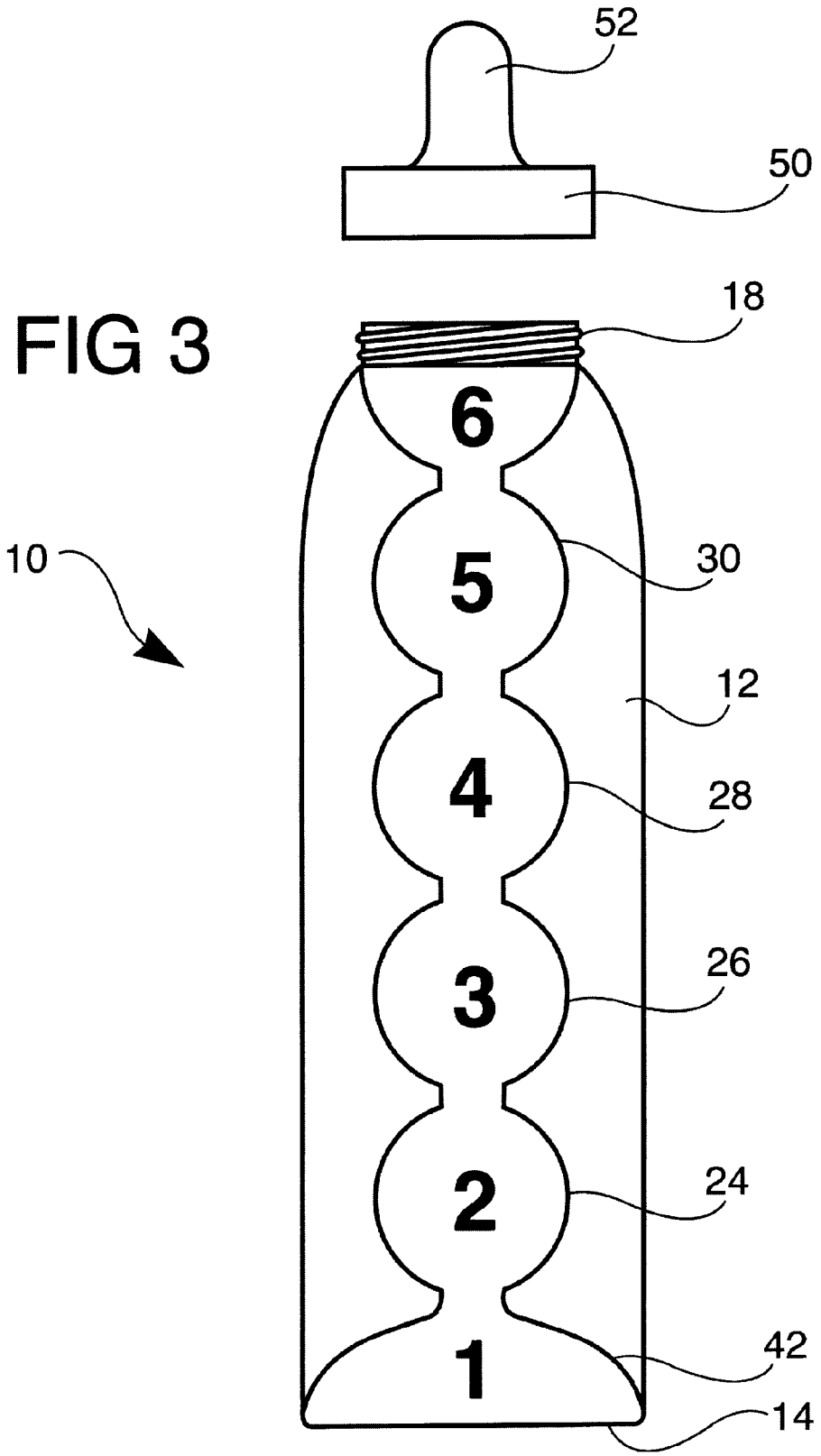
FIG. 3 is a front perspective view similar to FIG. 1 showing the cap and nipple removed.
Figure 4:
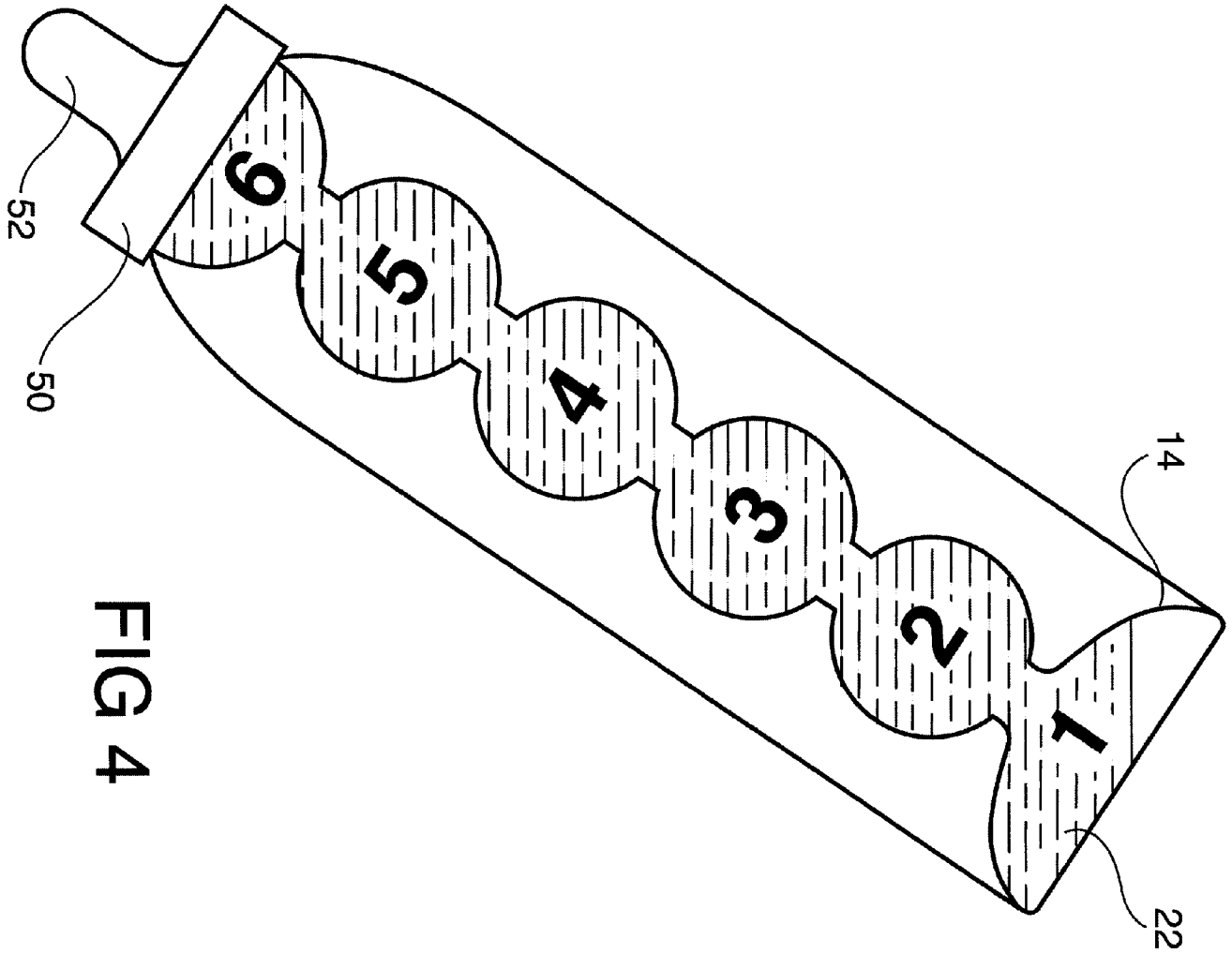
FIG. 4 is a front perspective view showing the full bottle in a tilted position for feeding a baby.
Figure 5:
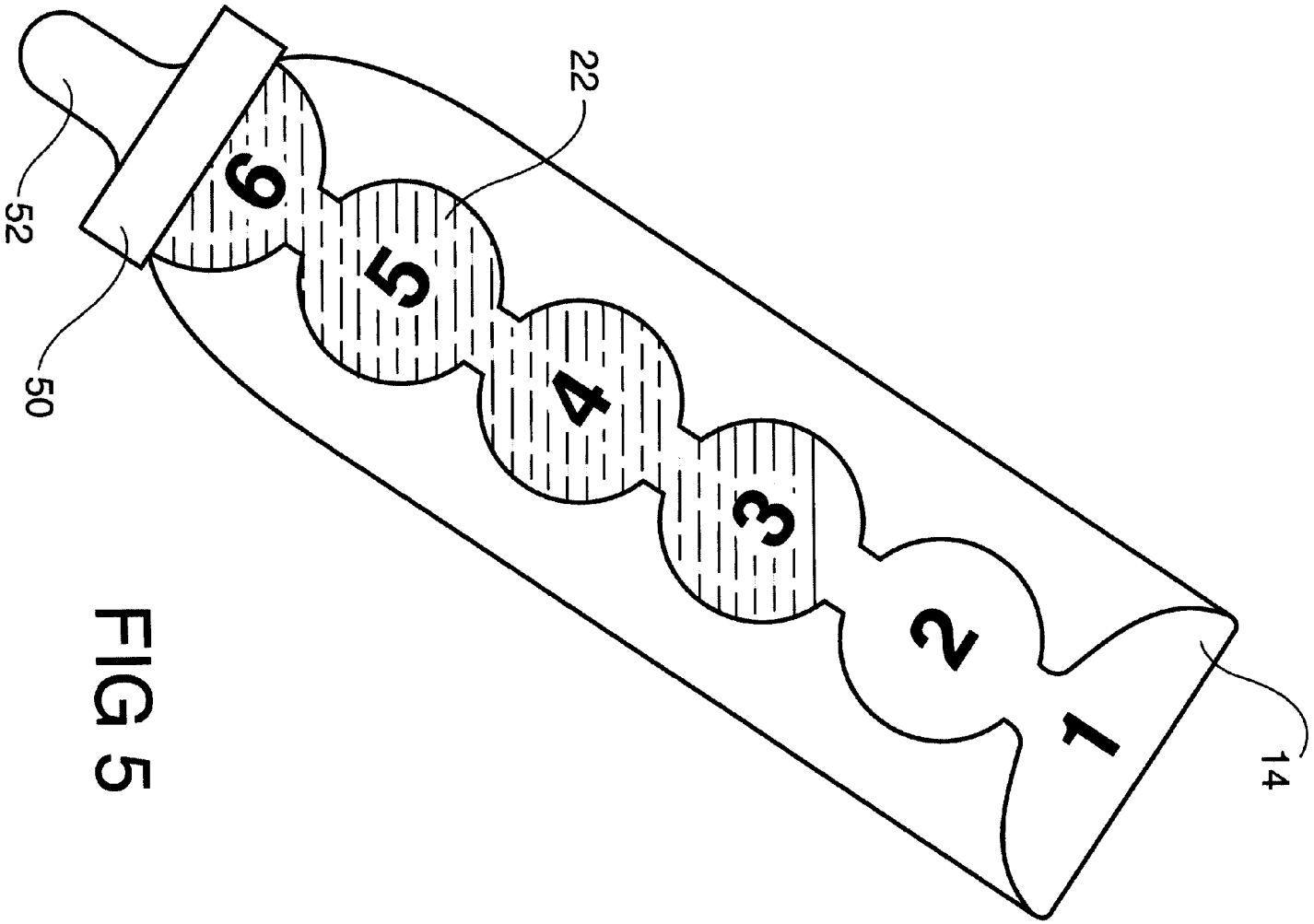
FIG. 5 is a view similar to FIG. 4 illustrating how the quantity of liquid consumed can be easily seen.

The bottle 10 is used in the following manner which is also essentially the same as most conventional baby bottles. With the cap 52 removed, milk or other liquid 22 is poured into the interior 20 of the housing 12 which fills the spheres 24, 26, 28, 30 and 32 and the funnel 42 as shown in FIG. 2. The bottle 10 is then tilted into the position shown in FIG. 4 for feeding the liquid to a baby or infant. As can be seen in FIG. 4, the liquid 22 is clearly visible from outside of the housing 12 and fills substantially all of the interior space within the spheres and funnel. As the baby consumes the liquid 22, the amount and level of the liquid decreases as each successive sphere is emptied as shown most clearly in FIG. 5. By viewing the numbers on the spheres, the caregiver can easily and readily see how much liquid has been consumed without having to remove the bottle from the baby's mouth.

The present invention may be embodied in other specific forms without departing from the spirit or essential attributes thereof and accordingly, reference should be made to the appended claims rather than to the foregoing specification as indicating the scope of the invention.

I claim:

1. A baby bottle comprising:

a container having an interior space, a closed end and an open end;

a cap adapted to be attached to said open end of said container;

a nipple adapted to be carried by said cap so as to be in fluid communication with said interior space;

said interior space being formed by a plurality of substantially the same size and substantially transparent spaced apart hollow spherical members arranged vertically and axially aligned one above the other with their interiors being in fluid communication with each other through a plurality of tubes, said tubes having a diameter of no greater than one-third the diameter of said hollow spherical members;

the uppermost of said spherical members including means for allowing said cap to be sealingly attached thereto whereby said nipple is in fluid communication with the interior of said uppermost spherical member;

a substantially transparent housing having a bottom wall and surrounding said hollow spherical members leaving a surrounding space between said hollow spherical members and said housing, said hollow spherical members being visible through said housing, and an inverted funnel-shaped member secured to and in fluid communication with the lowermost hollow spherical member, the lowermost part of said funnel-shaped member being sealed to said bottom wall of said housing thereby preventing liquid within said funnel from entering said surrounding space.

2. The baby bottle as claimed in claim 1 wherein said plurality of hollow spherical members includes at least three spherical members.

3. The baby bottle as claimed in claim 2 wherein there at least five hollow spherical members.

4. The baby bottle as claimed in claim 1 wherein the interior of each of said hollow spherical members holds approximately one ounce of liquid.

5. The baby bottle as claimed in claim 1 wherein each of said spherical members includes a number thereon that is visible through said housing.

* * * * *